US005570966A

United States Patent [19]

Phelan

[11] Patent Number: 5,570,966

[45] Date of Patent: Nov. 5, 1996

[54] FLOW-THROUGH BRUSH FLUID DISPENSING CONTAINER

[76] Inventor: John J. Phelan, 109 Jeanette Ave., Inwood, N.Y. 11696

[21] Appl. No.: 438,028

[22] Filed: May 8, 1995

[51] Int. Cl.[6] ..... A46B 11/02; A46B 11/04

[52] U.S. Cl. ..... 401/183; 401/186; 401/276; 401/288

[58] Field of Search ..... 401/183, 186, 401/276, 288

[56] References Cited

U.S. PATENT DOCUMENTS

| | | | |
|---|---|---|---|
| D. 282,318 | 1/1986 | Herzfeld | D4/104 |
| 371,899 | 10/1887 | Osborne | 401/276 |
| 2,860,359 | 11/1958 | James | 401/183 |
| 3,029,464 | 4/1962 | Springmeier | 401/183 |
| 3,372,975 | 3/1968 | Johnson | 401/183 |
| 4,375,924 | 3/1983 | Lemire | 401/173 |
| 4,863,302 | 9/1989 | Herzfeld et al. | 401/289 |
| 5,186,559 | 2/1993 | Fu | 401/186 X |
| 5,294,207 | 3/1994 | Keating et al. | 401/288 |

FOREIGN PATENT DOCUMENTS

| | | | |
|---|---|---|---|
| 548633 | 11/1957 | Canada | 401/276 |
| 1276507 | 8/1968 | Germany | 401/288 |

*Primary Examiner*—Steven A. Bratlie
*Attorney, Agent, or Firm*—Richard L. Miller, P.E.

[57] ABSTRACT

A flow-through brush fluid dispensing container comprising a squeeze bottle for holding a liquid therein, having a combine manual and automatic mechanism for venting air into the container. A removable elongated stem extends from the bottle for transferring the contents therein therethrough. A plurality of bristles are provided at a distal free end of the stem, for receiving the liquid squeezed from the bottle through the stem, so that the bristles can apply the liquid onto various articles and surfaces.

5 Claims, 1 Drawing Sheet

FLOW-THROUGH BRUSH FLUID DISPENSING CONTAINER

BACKGROUND OF THE INVENTION

The instant invention relates generally to brushes and more specifically it relates to a flow-through brush fluid dispensing container.

Numerous brushes have been provided in prior art that are adapted to include bristles set in handles which are used especially for cleaning or painting. For example, U.S. Pat. No. 4,375,924 to Lemire; U.S. Pat. No. 4,863,302 to Herzfeld et al.; U.S. Pat. No. 5,294,207 to Keating et al. and Des. 282,318 to Herzfeld all are illustrative of such prior art. While these units may be suitable for the particular purpose to which they address, they would not be as suitable for the purposes of the present invention as heretofore described.

SUMMARY OF THE INVENTION

A primary object of the present invention is to provide a flow-through brush fluid dispensing container that will overcome the shortcomings of the prior art devices.

Another object is to provide a flow-through brush fluid dispensing container that is a plastic squeeze bottle with a removable elongated bristle stem which applies barbecue sauce and the like through the bristle stem onto foods during the cooking of the foods and which has a long reach, so that the heat from the barbecue does not damage the bottle or burn the hands of the chef.

An additional object is to provide a flow-through brush fluid dispensing container in which the plastic squeeze bottle and the removable elongated bristle stem can be washed clean and reused again.

A further object is to provide a flow-through brush fluid dispensing container that is simple and easy to use.

A still further object is to provide a flow-through brush fluid dispensing container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
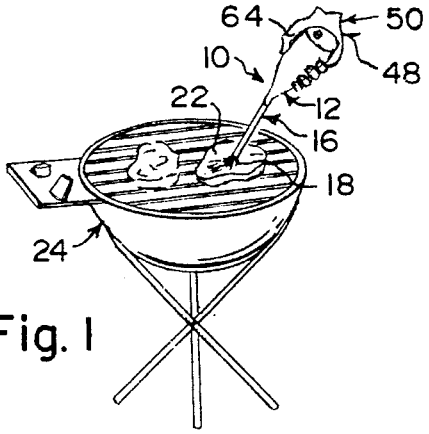
FIG. 1 is a diagrammatic perspective view of the instant invention being used with an open barbecue grill.
Figure 2:
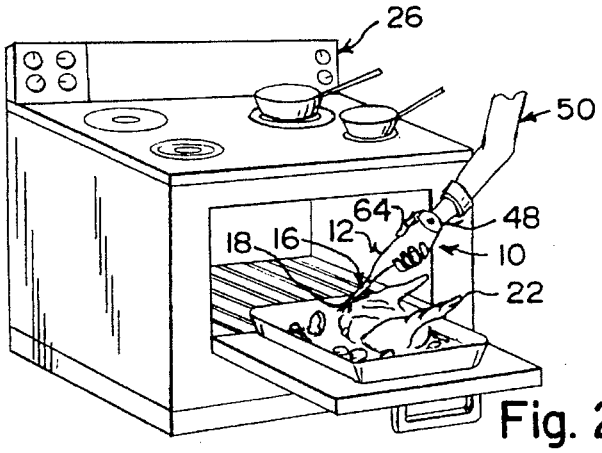
FIG. 2 is a diagrammatic perspective view of the instant invention being used with a cooking range.
Figure 4:
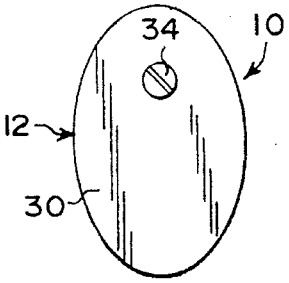
FIG. 4 is an enlarged end view taken in the direction of arrow 4 in FIG. 3.
Figure 5:
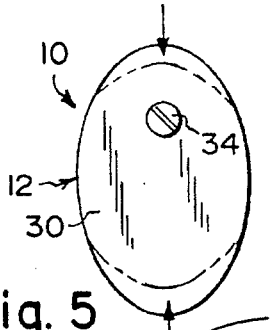
FIG. 5 is an enlarged end view taken in the direction of arrow 5 in FIG. 3, illustrating the bottle being squeezed to help dispense the contents therein.
Figure 3:
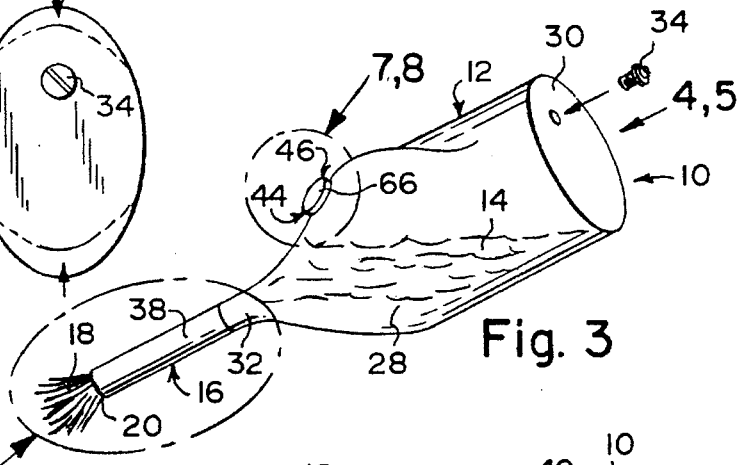
FIG. 3 is a diagrammatic perspective view of the instant invention per se with the filler cap exploded therefrom.

Turning now descriptively to the drawings, in which similar reference characters denote similar elements throughout the several views, FIGS. 1 through 8 illustrate a flow-through brush fluid dispensing container 10 comprising a squeeze bottle 12 for holding a liquid 14 therein. An elongated stem 16 extends from the bottle 12. A plurality of bristles 18 are disposed at a distal free end 20 of the stem 16, and receive the liquid 14 squeezed from the bottle 12 through the stem 16, so that the bristles 18 can be utilized to apply the liquid 14 onto various articles 22, such as food in an open barbecue 24 in FIG. 1 and food in a cooking range 26 in FIG. 2.

The squeeze bottle 12 consists of a flexible hollow body 28 that has a substantially flat base 30 at a first end and a hollow cylindrical neck 32 extending from a second end. A filler cap 34 is threaded into the flat base 30, so as to allow for insertion of the liquid 14 through the flat base 30 when the filler cap 34 is removed. A structure 36 that is disposed on a distal end of the hollow cylindrical neck 32 attaches the elongated stem 16 thereto in a removable manner. The elongate stem 16 is a hollow cylindrical tube 38, has the same outer diameter as the hollow cylindrical neck 32.

Figure 6:
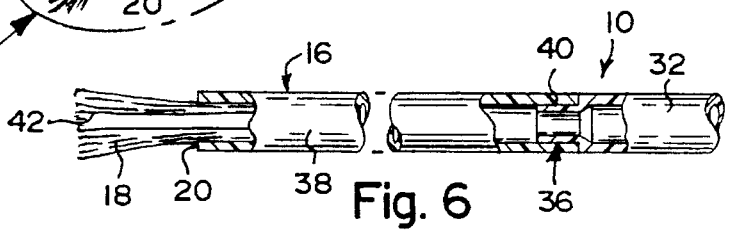
FIG. 6 is an enlarged diagrammatic side view of the components enclosed in the dotted curve indicated by arrow 6 in FIG. 3, with parts broken away and in section, showing the stem in greater detail and which may be manufactured in a variety of lengths.

The attaching structure 36, shown in FIG. 6, is a small hollow cylindrical extension piece 40 that is integral with and extends from a distal end of the hollow cylindrical neck 32. The small hollow cylindrical extension piece 40 has an outer diameter substantially equal to an inner diameter of the hollow cylindrical tube 38. The hollow cylindrical tube 38 fits snugly onto the small hollow cylindrical extension piece 40 while permitting the liquid 14 to flow freely therethrough. The bristles 18 have a central channel opening 42 therethrough and extend from the hollow cylindrical tube 38, so that the liquid 14 can flow through the central channel opening 42 and saturate the bristles 18 for application onto the various articles 22.

The squeeze bottle 12 further includes a component 44 that may operate automatically or manually, so as to allow for venting air into the flexible hollow body 28, so that the liquid 14 can flow freely therefrom. The air venting component 44 is a push button air release valve 46 that is integrally formed with a bellows 56 and a valve seat 60 on the flexible hollow body 28, and when depressed by a finger 64 of a hand 48 of a person 50 holding the flexible hollow body 28 will allow air to enter therein.

Figure 7:
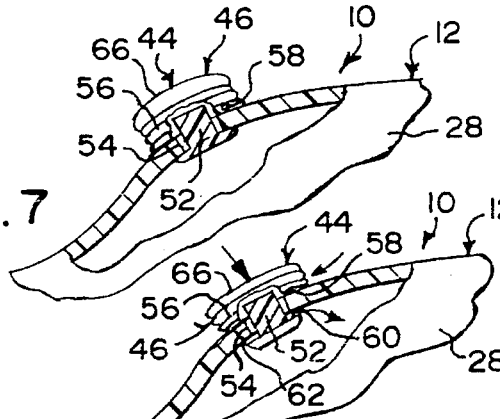
FIG. 7 is an enlarged view of the components enclosed in the dotted circle indicated by arrow 7 in FIG. 3, with parts broken away and in section, showing an air release valve in a closed position.
Figure 8:
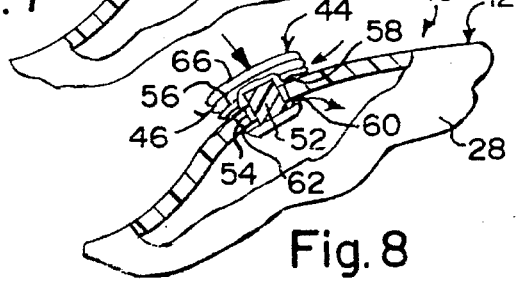
FIG. 8 is an enlarged view as indicated by arrow 8 in FIG. 3, with parts broken away and in section, showing the air valve being depressed in order to permit air to enter the bottle easily.

The push button air release valve 46, as best seen in FIGS. 7 and 8, contains a plunger 52 extending through a wider aperture 54 in the flexible hollow body 28. A compressible cap 66 is integrally formed with a bellows 56 that has an air hole 58 therethrough. When the compressible cap 56 is pressed downwardly, as in FIG. 8, the plunger 52 will move the valve seat 60 away from the inner cooperating surface 62 of the container 28 and accordingly open the aperture 54, so as to allow air to pass through the air hole 58 and the aperture 54 into the flexible hollow body 28. The bellows serves the dual purpose of biasing the plunger outwardly, so as to maintain the valve seat in a normally closed position and also to help prevent dirt and other contaminants from entering the container.

OPERATION OF THE INVENTION

To use the flow-through brush fluid dispensing container 10, a person 50 simply attaches the hollow cylindrical tube 38 onto the hollow cylindrical extension piece 40 on the hollow cylindrical neck 32. The person 50 now grips the flexible hollow body 28 by his/her hand 48. The bottle 12 is squeezed to force some of the liquid contents 14 therein out through the brush 18 and on to the cooking food 22. Quite often, the contents 14 of a typical barbecue sauce can be reasonably viscous and thick. Accordingly when the grasp on the bottle is released the bottle will attempt to recover its undeformed original shape. It is at this point that air would normally gurgle slowly up through the sauce trapped within the neck 32 of the bottle and possibly drawing any charcoal or other food material into the contents 14 of the bottle and thus contaminating the contents of the bottle. Because of the differential of pressure created when the bottle attempts to recover its undeformed shape air will be automatically drawn in through the bellows 56 and valve seat 60. It now becomes apparent that this bellows valve arrangement has the two additional purpose of allowing the bottle to recover its shape quickly while at the same time preventing contaminates from being drawn up the neck.

Alternatively, when desirable the compressible cap 66 of the push button air release valve 46 can be pressed downwardly by the finger 64 while the bottle 12 is being held, and not squeezed, by the hand 48 and pointed toward the food 22. This allows a liquid 14 which is not viscous, but thin and quite fluid, to flow easily from the bottle 12 into the bristles 18 with a high degree of control without squeezing or deforming the bottle. The bristles 18 can now apply the liquid 14 onto the food articles 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

The invention claimed is:

1. A flow-through brush fluid dispensing container comprising:

a) a squeeze bottle for holding a liquid therein, said squeeze bottle having an inner surface, a throughbore with a diameter, and an undeformed shaper the liquid selected from the group consisting of viscus and non-viscous;

b) an elongated stem extending smoothly from said squeeze bottle, so that the liquid held in said squeeze bottle is not stagnated where said elongated stem extends from said squeeze bottle, said elongated stem having a distal free end;

c) a plurality of bristles disposed at said distal free end of said elongated stem, said plurality of bristles receiving the liquid squeezed from said squeeze bottle through said elongated stem, so that said plurality of bristles can apply the liquid onto various articles;

d) a plunger passing through said throughbore of said squeeze bottle, said plunger having a lower end, and an external portion with an upper end extending outside said squeeze bottle;

e) a valve seat disposed in said squeeze bottle and cooperating with said inner surface of said squeeze said plunger and having a diameter greater than said bottle, said valve seat disposed on said lower end of diameter of said throughbore of said squeeze bottle, so that said valve seat closes said throughbore of said squeeze bottle in a normally closed position;

f) a bellows disposed outside said squeeze bottle and having an upper end, a lower end disposed on said squeeze bottle, and a laterally disposed vent throughbore, said external portion of said plunger disposed in said bellows, so that said plunger is biased upwardly and said valve seat is maintained in said normally closed position, so that contaminants are prevented from entering said squeeze bottle, and so that said squeeze bottle automatically recovers said undeformed shape after being squeezed since a differential pressure is created when said squeeze bottle attempts to recover said undeformed shape after being squeezed which causes air to be automatically drawn through said laterally disposed vent throughbore of said bellows and through said throughbore of said squeeze bottle into said squeeze bottle which causes said squeeze bottle to recover said undeformed shape; and g) a cap disposed outside said squeeze bottle and being disposed on said upper end of said external portion of said plunger and on said upper end of said bellows, so that when the liquid is non-viscous and said cap is manually pressed downwardly said laterally disposed vent throughbore of said bellows is not obstructed and said plunger moves said valve seat away from said inner surface of said squeeze bottle and opens said throughbore of said squeeze bottle so as to allow air to pass through said laterally disposed vent throughbore of said bellows and through said throughbore of said squeeze bottle and causes the non-viscous liquid to flow easily from said squeeze bottle into said plurality of bristles with a high degree of control without squeezing and deforming said squeeze bottle.

2. The flow-through brush fluid dispensing container as recited in claim 1, wherein said squeeze bottle includes:

a) a flexible hollow body having a flat base disposed at a first end and a hollow cylindrical neck extending smoothly from a second end, said flat base of said flexible hollow body having a throughbore;

b) a filler cap threaded into said throughbore of said flat base, so as to allow for insertion of the liquid through said flat base when said filler cap is removed; and c) means disposed on a distal end of said hollow cylindrical neck for attaching said elongated stem thereto in a removable manner.

3. The flow-through brush fluid dispensing container as recited in claim 2, wherein said elongated stem is a hollow cylindrical tube having the same outer diameter as said hollow cylindrical neck.

4. The flow-through brush fluid dispensing container as recited in claim 3, wherein said attaching means is a small hollow cylindrical extension piece integral with and extending from a distal end of said hollow cylindrical neck, said small hollow cylindrical extension piece having an outer diameter equal to an inner diameter of said hollow cylindrical tube, so that said hollow cylindrical tube can snugly fit onto said small hollow cylindrical extension piece with the liquid flowing freely therethrough.

5. The flow-through brush fluid dispensing container as recited in claim 4, wherein said plurality of bristles have a central channel opening therethrough and extend from said hollow cylindrical tube, so that the liquid can flow through said central channel opening to saturate said plurality of bristles for application onto the various articles.

* * * * *